United States Patent [19]

Acquaviva et al.

[11] Patent Number: 4,814,822

[45] Date of Patent: Mar. 21, 1989

[54] METHOD AND APPARATUS FOR AUTOMATIC "TWO-UP" COPYING WITH INTERMEDIATE LATENT IMAGE COPIERS

[75] Inventors: Thomas Acquaviva, Penfield; Richard E. Smith, Fairport, both of N.Y.

[73] Assignee: Xerox Corporation, Stamford, Conn.

[21] Appl. No.: 59,653

[22] Filed: Jun. 8, 1987

[51] Int. Cl.[4] ..... G03G 21/00

[52] U.S. Cl. ..... 355/14 SH; 355/14 R; 355/133

[58] Field of Search ..... 355/3 R, 3 SH, 14 R, 355/14 SH, 23, 24, 25, 26, 77, 133

[56] References Cited

U.S. PATENT DOCUMENTS

| | | | |
|---|---|---|---|
| 3,637,306 | 1/1972 | Cooper | 355/15 |
| 3,647,293 | 3/1972 | Queener | 355/15 |
| 4,021,109 | 5/1977 | Tanaka et al. | 355/24 X |
| 4,035,073 | 7/1977 | DelVecchio | 355/24 |
| 4,052,054 | 10/1977 | Cardwell et al. | 271/227 |
| 4,219,271 | 8/1980 | Ohkubo et al. | 355/14 R |
| 4,248,951 | 2/1981 | Ando et al. | 430/53 |
| 4,255,507 | 3/1981 | Ohara et al. | 430/53 |
| 4,260,241 | 4/1981 | Honma et al. | 355/14 R |
| 4,261,661 | 4/1981 | Thiers | 355/24 |
| 4,265,531 | 5/1981 | Ohara et al. | 355/3 SC |
| 4,334,765 | 6/1982 | Clark | 355/24 X |
| 4,592,651 | 6/1986 | Oikawa et al. | 355/72 |
| 4,727,402 | 2/1988 | Smith | 355/14 SH |

*Primary Examiner*—Fred L. Braun

[57] ABSTRACT

A copier of a type where an undeveloped electrostatic intermediate latent image from a document sheet may be temporarily retained on an electrostatic latent image retention member before being developed and transferred to a copy sheet, with document handling apparatus for sequentially feeding document sheets for individual copying, preferably automatically reordered in signature page order, with a system for sequentially forming at least two closely circumferentially adjacent plural latent images from at least two sequentially copied documents, and for directly sequentially developing and transferring these plural images in one pass onto one side of a single copy sheet. Apparatus is also shown for inverting and representing the copy sheet for similarly receiving plural images on the other side thereof, and for repeating the above steps to form sets of signature copy sheets.

25 Claims, 4 Drawing Sheets

METHOD AND APPARATUS FOR AUTOMATIC "TWO-UP" COPYING WITH INTERMEDIATE LATENT IMAGE COPIERS

Cross-reference is made to commonly assigned U.S. application Ser. No. 912,014 filed Sept. 26, 1986 by Stephen R. Partilla and Ernest L. Dinatale entitled "Two-Up Automatic Document Feeder For Simplex To Duplex Copying" now U.S. Pat. No. 4,727,401 Ser. No. 897,570 filed Aug. 18, 1986 by Henry T. Bober and Michael S. Doery entitled "Interactive System for Signature Production" now U.S. Pat. No. 4,708,469 Ser. No. 944,693 filed Dec. 18, 1986 by this same Richard E. Smith entitled "Automatic Copier Signature Set Production" now U.S. Pat. No. 4,727,402 and Ser. No. 029,026 filed Mar. 31, 1987 by this same Thomas Acquaviva and Thomas R. Cross entitled "Automatic 'Two-Up' Document Registration and Feeding For Copiers", now U.S. Pat. No. 4,731,637. They are also incorporated by reference herein.

The system disclosed herein relates to plural image copying and document handling, and, more particularly, to plural document image registration and copying, with individual document presentation to the imaging station of a copier, particularly suited for a copier with either intermediate latent image storage and transfer or for "two-cycle xerography", and for providing "two-up" copying, and especially signature copying, therewith.

The exemplary system disclosed herein provides an image of at least two originals on one sheet of copy paper from adjacent images formed from sequentially individually copied originals using a latent image retention type of copier which may be a copier with a separate latent image retention surface or a "two-cycle" type of copier. A conventional pre or postcollating document handler may be used, i.e., a conventional document handler which registers one document at a time on the copier platen. One document sheet is brought to the platen, exposed, and ejected, and then a second document sheet is registered in the same imaging position, as in conventional copying. However, in the first detailed example herein, instead of placing the resulting images directly onto a final photosensitive drum or belt and having them separated by an intersheet pitch distance, as in conventional xerography, here both electrostatic latent images may be registered side-by-side on a charged screen-type photosensitive intermediate member. The second document image is registered on the same screen-type member adjacent the first image, using any conventional timing technique. This combined (paired) intermediate electostatic latent image is then transferred to a second chargeable member where the latent image is conventionally developed. This developed image is then transferred to a single sheet of copy paper. In the second embodiment herein the two adjacent latent images are formed directly on a conventional photoreceptor in sequential rotations thereof using two-cycle xerography.

In this way, for example, two conventional copy sheets letter-size (21.6 cm×28 cm) 8½×11 inch) documents can be registered and transferred to an single 11×17 inch (28 cm×43 cm) conventional double-size copy sheet or reduced 64.7% and transferred on one conventional letter-size copy sheet, by copying both originals side-by-side onto one copy sheet with the two original images in portrait format and the copy sheet fed in landscape format. If documents are imaged in signature sequence and the copies are duplexed, the copy sheet may be a signature sheet, which may be folded and combined with the other signatures to produce a signature copy set. Staples can be placed in the center of the set of signatures to produce true book mode output. With a programmed reordering system as disclosed herein, a stack of originals can be page ordered and imaged in the proper sequence to produce any desired combination of two-up or precollation signature copying. Note that said double size copy sheets can desirably be fed short-edge-first (portrait feeding orientation) through a copier of conventional photoreceptor and paper path widths capable of normally feeding normal size copy sheets long-edge-first (landscape feeding orientation).

To express it another way, in both exemplary systems disclosed in further detail herein, a known type of photo copying machine is used which provides latent image retention. This copier is used here to provide two original document images directly adjacent to one another on one copy sheet. One document at a time may be placed on the platen in the usual manner. A latent image is made on the latent image retaining member of the first document, but it is not immediately developed. The first document is then removed and a second document may be placed in the same platen location as the first document. A latent image is then made of this second document and placed adjacent to the latent image of the first document on the latent image retention member, which has been rotated into the correct position in the meantime. Both adjacent latent images are then developed together, and transferred together onto one copy sheet in the normal manner.

Thus, 2-up copying is provided by using image retention of the separated, time spaced, sequential acquisition of two latent images, which are made side-by-side (end to end) and developed and printed in direct immediate sequence. This is enabled by sequentially storing at least one of the latent images on an image retention member. This is an effective system for "composing" a single latent image from two sequentially fed documents which combine to make the single image. It is particularly applicable to Canon and other electro-print screen imaging processes, as are commercially available in Canon copier products; or two-cycle type xerography, in which the image cleaning and development systems are disabled during alternate rotations of the photoreceptor. Various applications are available to such sequential composition of common latent images, in addition to signature printing. An important application is with optical image size reduction copying.

The following U.S. patents assigned to Canon describe the latent electrostatic image intermediate storage and transfer process, which can also be called a photosensitive screen process, or an ion transfer process, which may be used here: U.S. Pat. Nos. 4,219,271, and 4,248,951. Other such Canon references are U.S. Pat. Nos. 4,255,507, 4,260,241 and 4,265,531. An earlier invention thereof is disclosed in U.S. Pat. No. 3,986,871 issued Oct. 19, 1976 to J. Blades et al (AMI), in interference with an equivalent of said U.S. Pat. No. 4,255,507. Also in this area are Olympus U.S. Pat. No. 4,325,625 and Canon U. K. No. 2,166,671 (German OLS No. 35 36 724). This process is indicated to have been used in a Japanese marketed Canon machine called the "Super X". Also noted is the Canon "NP-8500". [This latent image retention is not to be confused with electronic document image storing, e.g., Canon Japanese Laid-open No. 58-104561, June 22, 1983, Application No. 56-202402, Dec. 17, 1981 to N. Yukimura.] The subject system enables latent image retention on an intermediate for repeated transfer of that latent image to another surface for development and transfer to a final copy sheet. Because only a mirror modification of such known types of copiers is employed here, they need not be described herein in detail.

Likewise, two-cycle copiers are well known per se from, e.g., U.S. Pat. Nos. 3,637,306 to Cooper and 3,647,293 to Queener (IBM) and 4,589,759 to Fantuzzo, et al (Xerox) and 4,087,171 to Sawaoka, et al, including use for duplexing, Xerox Disclosure Journal Vol. 11, No. 5, p. 249, September/October 1986.

The problem addressed is that it is often desired to copy two or more original documents onto either one larger copy sheet or one sheet of the same size. The problems associated with doing this automatically are usually centered around handling the originals - each original must normally be registered in different positions on the platen simultaneously ("two-up"). The cross-referenced applications cited above show the orientation of the two documents on the platen for such traditional 2-up copying, and also for sequential copying.

Here, rather than simultaneously place two originals on the platen in two different locations, which requires substantial changes in document feeding and registration orientation, this technique for 2-up copying utilizes image retention and combination. With this technique, document sheet 1 is placed on the platen in a conventional location and with a conventional orientation, e.g., long-edge-fed and corner-registered into the upper left hand corner of the platen. A latent image is made onto the latent image storing member in the processor but it is not then developed. Next, document sheet 1 is removed and document sheet 2 is brought to the same location on the platen. The document exchange takes place using any conventional or appropriate document handler. Sheet 2 is imaged in the same manner but latent image 2 is placed adjacent to the latent image 1. Now both images are developed, or first transferred to another surface and developed and then transferred to a copy sheet in the normal manner. Preferably, a 90° difference in orientation of the copy sheet feeding relative to the document sheet feeding is provided, preferentially by long-edge-first document feeding and short-edge-first copy sheet feeding.

In this way, for example, as noted above, two conventional size documents can be imaged side-by-side on one large size copy sheet, or reduced 0.647× and placed on one conventional copy sheet. Also, two B5 size document images can be placed on one B4 size copy sheet. If originals are imaged in proper signature sequence, then signatures can be made automatically, using the duplex mode of the copier, e.g., in the same basic manner as taught by the above-cited application Ser. No. 944,693 to Richard E. Smith, but even more simply.

"Two-up" copying normally means that two (or more) document sheets or pages are placed on the same imaging station at one time, normally for the copying of both onto a single copy sheet. The copy sheet can be cut into two sheets, or center-folded. If both sides are appropriately copied before folding, (with another, appropriate, document image pair prited on the other side), then "signature" sheets can be produced. Two-up copying can save copy paper.

The term "two-up" as used herein is not intended to be limited to only two (one pair of) documents. The present system is also applicable to placing 2, 3, 4, or more document images on one copy sheet side at one time. Furthermore, signature sheets are sometimes referred to as "4-up" copies. Yet, this system can utilize the same, conventional, docment registration, platen, and feeding as for single documents. This system is also advantageous for automatically copying plural related business forms, post cards, or the like, onto single copy sheets with proper copying positioning, yet copied sequentially, i.e., not requiring a special, nonsequential, noncommercial, document handler.

A signature is a sheet containing plural (usually 4) printed pages (usually two on each side) with a page arrangement such that when such sheets are center-folded and nested one inside of the other with other signature sheets in a set they become one collated pamphlet, booklet, or book; or a quire forming one section of a larger book. The booklet copies may be formed from center-folded sheets of paper each carrying four copy images of the original documents made in a known signature page sequence (i.e., a particular known non-direclty-sequential placement of images on each signature sheet is essential to providing a finished folded signature set or booklet with a direct sequential page order).

One of the most difficult challenges constraining greater use of two-up copying copier art is the registration and placement of the conventional input documents, whether single page (simplex) or dual opposing page (duplex) documents. Most prior art two-up systems require maual document handling to simultaneously place two documents at a time on the platen and/or are relatively complex and not easily understood or used by the typical casual copier operator. It is desirable therefore to provide a new and improved automatic document sheet handling technique for input documents, especially a "dual mode" document handling system which can provide for normal, individual document copying as well as proper signature other "two-up" copying of plural document pages.

It is not surprising that signature copying, even though it is a desirable function or feature, is not commonly practiced on copiers except by experienced operators, and is very error prone. With manual document pair handling, one slip in any of the complicated process of document page variable orientation placement and spacing will result in unusable copies which must be destroyed, registered and recopied.

The present system allows and encourages casual operator signature printing or other "two-up" copying operations by eliminating the difficulty and complexity of proper manual page placements, page spacing and page orientation, etc., of the original document pairs.

The present system is usable with various document handlers, e.g., RDH, SADH, ADF and/or ADH systems, but especially plural mode RDH/SADH units. Yet the present system does not significantly increase conventional document handling complexity or cost in compatibly achieving this additional function.

One of the most difficult to achieve features for automatic document handling is the rapid, accurate, reliable, and safe registration of each document at the proper position for copying. Conventionally the document is desirably either center registered or corner registered (depending on the copier) by the document handler automatically at a preset registration position relative to the copier platen. At this registration position two orthogonal edges of the document are aligned with two physical or positional (imaginary) registration lines of the copier platen at which the original document is properly aligned with the copier optics and copy sheet/photoreceptor registration system for correct image transfer of the document image to the photoreceptor and then to the copy sheet. This registration accuracy is desirably maintained consistent within approximately one millimeter. If the docment is not properly registered, then undesirable dark borders and/or edge shadow images may appear on the ensuing copy sheet, or information near an edge of the document may be lost, i.e. not copied onto the copy sheet. Document misregistration, especially skewing, can also adversely affect further feeding and/or restacking of the documents.

In preferred types of copying systems the document is registered for copying overlying a selected portion of full sized (full frame) platen which is at least as large as the largest document to be normally copied automatically. In such systems the document is preferably either scanned or flashed while it is held stationary on the platen in the desired registration position. That is, in these full frame systems the document is preferably registered by being stopped and held during imaging at a preset position over the platen glass which is adjacent one side or edge thereof.

As shown in the art, and further discussed below, document handling systems have been provided with various document transports to move the documents over the copier platen and into registration. Such document platen transports may comprise single or plural transport belts or feed wheels, utilizing frictional, vacuum, or electrostatic sheet driving forces. Various combinations of such transports are known with various registration devices or systems. Preferably the same platen transport sheet feeder is used to drive a document onto and off the platen before and after copying as well as registering the document.

The cited art shows several approaches to registering a document for copying at an appropriate position relative to the transparent copying window. Some examples are disclosed in U.S. Pat. Nos. 4,043,665 issued Aug. 23, 1977 to J. R. Caldwell; 4,132,401 issued Jan. 2, 1979 to J. F. Gauranski, et al; or 4,295,737 or 4,391,505 issued Oct. 20, 1981 and July 5, 1983 to Morton Silverberg. Document registration can desirably be done without mechanical document stops on the platen, as shown there. A recent measured-stop registration system is taught in U.S. Pat. No. 4,579,444 issued Apr. 1, 1986 to T. S. Pinckney and H. J. Sanchez. U.S. Pat. No. 4,052,054 to Cardwell et al, (IBM) shows an SADH with a retractable preregistration gate. It is cited again further herein re "two-up" document presentation.

DH registration systems may also utilize multiple belts and document stopping registration fingers into the document path to stop the document at the desired registration position. Examples are disclosed in U.S. Pat. Nos. 4,589,651 issued May 20, 1986 to M. Silverberg (D/85119Q); 4,470,591 issued Sept. 11, 1984 to T. Acquaviva; 4,322,160 issued Mar. 30, 1982 to G. S. Kobus; and 3,844,522 issued Oct. 29, 1974 to C. D. Bleau et al. One example of a registration gate movable in and out of the document path from above the platen (from inside the document handler) is disclosed in U.S. Pat. No. 4,256,298 issued Mar. 17, 1981 to D. K. Ahern.

Examples of U.S. Pats. on servo-motor or stepper-motor driven original document feeders in general are U.S. Pat. Nos. 3,888,579; 4,000,943; 4,144,550; 4,283,773 and 4,455,018.

In some document handling systems a system for also side registering (laterally positioning) the document on the platen is used, i.e. aligning the original on both axes while on the platen, e.g. U.S. Pat. Nos. 4,411,418 or 4,335,954. However two axes on-platen registration is not required, and such lateral or second axis registration may be done upstream of the platen, as by confinement of the documents within the side guides in the document tray from which the documents are fed, or driving the sheet against a side guide, e.g. U.S. Pat. Nos. 4,257,587; 4,266,762 or 4,381,893.

Examples of document handling systems in which the document is registered on the platen using a fixed (non-retractable) registration stop agaist which the document is reverse-driven by a transport are disclosed, for example, in U.S. Pat. Nos. 4,146,220 issued Mar. 27, 1979 to P. Barton; 3,504,908 issued Apr. 7, 1970 to J. R. Kreuger; and 4,033,574 issued July 5, 1977 to K. K. Stange.

Of particular interest by way of art and background on signature copying of documents for pamphlet booklet printing on a copier is U.S. Pat. No. 4,334,765 issued June 15, 1982 to G. A. Clark (IBM). (Note that the word "of" should be before "signatures" at Col. 1, line 61.) This patent demonstrates the difficulty and complexity of document signature pair sheet handling. A recirculating document feeder is also briefly generally suggested but not shown. Said U.S. Pat. No. 4,334,765 discloses the preparation of booklets by permitting somewhat simplified operator manipulations of a copier which forms adjacent images from sequential original sheets. An automatic document feeder presents successive original documents from an input stack to the reproduction position. The original documents are initially fed to the copier in a first sequence but are alternate page (not all) imaged. Originals are sequentially fed into the machine, reduced in size and placed adjacent to each other on both sides of a copying paper sheet. The originals are then restacked and are again presented to the reproduction position with previously unimaged originals forming images on different portions of the same copy sheets. A sorter is used to collate the copy sheets. Said U.S. Pat. No. 4,334,765 also states at the beginning of Col. 2 that: "U.S. Pat. No. 4,188,881, filed July 28, 1977, originals are divided by the operator into two stacks which are used in rotation to prepare a master for double-size copy sheets."

Especially relevant to the present disclosure, there is incidentally mentioned in said U.S. Pat. No. 4,334,765, but apparently without an enabling description, in Col 9, lines 9–14 and Col 7, lines 14–23, respectively:

> . . . Alternatively, it is possible to completely image both halves of a copy sheet from successively selected ones of the original documents by imaging the original documents onto adjacent portions of the photoconductor surface before copying onto each copy sheet . . .
>
> Assuming that a selected image area on the carrier drum 5 carries a half-size version of the original document on the document glass 20, it is then possible to place this image on the blank copy sheet in path 8 of FIG. 2 in one of two ways. Either the sheet from the bins 6 and/or 7 is made to receive images on halves 801 and 802 of the carrier drum image 5 in two successive passes or the carrier drum 5 is imaged twice and then both image halves 801 and 802 are transferred to a copy sheet simultaneously in one pass.

U.S. Pat. No. 4,035,073 issued July 12, 1977 to DelVecchio discloses a duplex copying machine. as disclosed in Col. 4, line 50 through Col 5, line 8, re the FIG. 5 embodiment, a latent image of both sides of an original is transmitted to two photoconducting drums. While the first copy sheet is receiving the image of the top side of the original from one drum, a second copy sheet can receive the image of the bottom side of the original from the other drum. The cycling process continues.

U.S. Pat. No. 4,095,979 issued June 20, 1978 to DiFrancesco et al discloses a duplex copying apparatus in which the top and bottom unfixed images of the original are formed sequentially on an image transfer member as shown in FIG. 2. The unfixed images are developed and transferred to opposite sides of a copy sheet. Finally, the copy sheet having unfixed images on both sides is transported to an image fixing station, where both images are fixed to the copy sheet. This is also disclosed in DelVecchio, supra.

U.S. Pat. No, 4,261,661 issued Apr. 14, 1981 to Thiers, discloses an apparatus which can form single-sided copies from double-sided originals. The photoconductive element is able to form two images on a copying sheet in one turn, as described in Col. 6, lines 34–61.

U.S. Pat. No. 4,592,651 issued June 3, 1986 to T. Oikawa, et al (Ricoh) shows a copier with a duplex recirculating document handler and a center-folding book-binding device for the copies. Cols. 14–15 describe some signature copying formulas and Cols. 15–16 describe document copying sequences using immediate duplexing. However, this system requires 4 copying passes for each copy sheet being signatured, and requires immediate duplex document inversion. A similar disclosure is apparently in U.S. Pat. No. 4,640,611 issued Feb. 3, 1987 to E. Ohdake, T. Oikawa, et al (Ricoh). Specifically taught in Col. 9, lines 51–65, inter alia, is feeding the documents transversely and the copy paper longitudinally, Said U.S. Pat. No. 4,334,765 at the beginning of Col. 2 refers to the "Xerox 7000 Signature Maker" "operator's instructions 610P2625C". It is believed that this refers to a printed cardboard "slide rule" type device provided for several years by Xerox Corporation for assisting the operator in the difficult task of manually reordering the pages of the original document sheets into the reordered page sequences for a proper signature sequence of manual "two-up" document copying to provide signature copies, for a selected number of originals set on this "slide rule" at a corresponding slideout position. However, the "7000" copier required manual document feeding and placement for "two-up" copying. Thus, it was known as described in the operator's instructions for the Xerox "7000" machine signature maker to manually use a calibrated table and to manually follow the step-by-step instructions for the placement of the correct order of originals on a platen.

The making of signatures for booklet-making is also described in the 1985 printed operator's manual for the Xerox Corporation "1090" copier at pp. 25–27. A chart providing document page presentation orders is provided. Although this copier has a recirculating document feeder, it is not used for document pairs feeding or signature printing. Signature printing is done by manually reordering and presenting document sheets, as with the "7000" copier as previously described. The Xerox "1090" copier operator manual describes a step-by-step procedure to place documents on the platen with reference to a numbering table. As noted above, utilizing the large (greater than 11×7 inch) size copying capacity of the platen to copy two letter size (8½×11 inch) documents simultaneously placed on the platen together with optical reduction can produce one side of a signature page copy of each document pair.

There is a known form of signature printing in which the "pages" of the "originals" are electronic master images, electronically arranged, rather than normal physical document sheets. The "Xerox" "9700" and "8700" electronic laser printers may be operated with automatic signature printing capabilities, referred to as "signature imposition" and specifically as the "Xerox Integrated Composition System" or "XICX", in commercial use since at least March 1981, as understood. However, this system requires a computer and plural page electronic image storage. It runs software developed several years ago for electronic photocomposition typesetting. This can produce copy sheet output in signature sheets which are correctly "four-up", i.e. 4 pages on each sheet, two on each side, so that, for example, a set of signatures of 8 and one-half by 11 inch standard letter size sheets may be center-folded (once) into a 5 and one-half by 8 and one-half inch booklet. Collated sets of a publication can thus be made with the XICX system on the "9700" printer. This system cannot, of course, directly copy or rearrange conventional document sheets.

As to plural document feeding other than for signature printing, U.S. Pat. No. 4,315,687 issued Feb. 16, 1982 to Breuers et al (Océ-Nederland) and U.S. SIR H21 published Feb. 4, 1986, discloses simultaneously copying plural small original sheets with a mask (form overlay) for providing additional information on the copy sheet. Likewise, a parallel document card stock feeder for a copier is shown in Japanese Application No. 54-164764 filed Dec. 20, 1979 by Ricoh Co., Ltd. laid open July 17, 1981 as No. 56-88064 and Pat. No. 56-88155(A).

The concept of manually positioning two regular size documents on the platen for copying simultaneously onto a single larger copy sheet (known as the "two-up" copying) is disclosed, for example, as early as U.S. Pat. No. 3,402,628 to Redding. Note particularly the paragraph at the beginning of Col. 1. This is not for signature printing. Rather, it is for making plural copies from one copy sheet by subsequently slitting the copy sheet into separate copies. There are various other "two-up" document copying or printing systems in which the purpose and result it is likewise to cut the copy sheet in half to make separate copy sheets of each document, not signatures. A further example is U.S. Pat. No. 4,198,881 issued Feb. 19, 1980 to E. C. Bruning (AM International, Inc).

U.S. Pat. Nos. 3,288,459 issued Nov. 29, 1966 to A. M. Hitchcock et al, 3,326,548 issued June 20, 1967 to G. C. Wright, and 4,052,054 issued Oct. 4, 1977 to W. R. Cardwell et al (IBM), disclose an original document feeder for simultaneously feeding two original documents to be copied simultaneously. The former two illustrate and particularly describe in Col. 3, middle, through Col. 4, a document tray 2 with a reciprocating plate 54 adapted to hold two documents. It places the documents on a moving belt transport 3 for transporting the documents through a downstream scanning station 4. The ejection of the documents is subsequently by that transport belt into a tray 92. However, this is not for signature printing. The latter (Cardwell et al) discloses feeding two documents onto a platen to be copied simultaneously with a single document feeder. Parallel two-up document feeding is also briefly discussed in a January/February 1985 Xerox Disclosure Journal Publication by the same Thomas Acquaviva., Vol. 10, No. 1, pp. 45–49, at p. 48. Also noted is the January/February 1985 Xerox Disclosure Journal, Vol. 10, No. 1, pp. 45–49, noting particularly page 48, the first paragraph, especially lines 10–24 are "two-up" and document rotation. Note that this rotation is manual, and is not for signature printing, but the reference illustrates the problems and operator complexity in this art area.

U.S. Pat. No. 4,235,431 issued Nov. 25, 1980 to Abrams et al discloses a machine for transporting documents for copying which maintains a preselected inter-document gap. The documents (e.g., checks) are automatically fed from a stack onto a conveyor apparatus. A pair of rotatable gate members rotates into and out of the path of the conveyor. The gate members interrupt the advancement of the documents and maintain a spacing therebetween.

Japanese Laid-open Patent Application No. 60-2942, Jan. 9, 1985 to Isaki, filed June 21, 1983 as No. 58-111389, teaches an apparatus for feeding two originals onto the exposure glass of a copying machine. A first original document is moved, by a system of rollers and dual conveyors into position upon a platen. Next, a second original document is moved up to near the rear of the first document, using an on-platen stopper so both may be imaged onto a single sheet of paper.

Also noted for applications of the present system are "split scan" systems wherein two document pages are presented to the platen at the same time, but normally in a "split scan" mode one page is copied at a time. Note, for example, the 2-up special scanning and/or duplexing systems of Canon U.S. Pat. Nos. 4,017,173 and 4,098,551 issued Apr. 12, 1977 and July 4, 1978 to Komori et al; Canon U. K. No. 1,499,412 published Feb. 1, 1978; Ricoh U.S. Pat. No. 4,218,130 issued Aug. 19, 1980 to Satomi et al; Minolta U.S. Pat. No. 4,453,819 issued June 12, 1984 to Wada et al and Sharp U.S. Pat. No. 4,639,120 issued Jan 27, 1987 to Matsuura et al..

Also noted re means for placing more than one original sheet at a time in the imaging station area is U.S. Pat. No. 4,635,555, issued Jan 18, 1972 to A. Kurahashi, et al (Canon).

Since the exemplary embodiment shown and disclosed herein has utility for use with an integral modular folder/fastener unit for making finished booklets from the collated signature sets output of the copier, further referenced in addition to U.S. Pat. No. 4,592,651, supra, is Xerox Corporation U.S. Pat. No. 4,595,187 issued June 17, 1986 to H. L. Buber (filed July 1985) which discloses an on-line saddle fastening accessory with a roof-shaped compiler and means for saddle-fastening each compiled booklet, for a collated output copier with an RDH. Other signature binders are well known in the printing arts, e.g. U.S. Pat. Nos. 3,554,531 issued Jan. 12, 1981 and 4,478,398 issued Oct. 23, 1984 to W. J. Stobb. U.S. Pat. No. 4,416,046 issued Nov. 22, 1983 to R. E. Stokes, discloses a stitcher and indicates in Col. 1, line 9 that it may be used for binding signatures.

A center-folding system is also taught, for example, in U.S. Pat. No. 1,463,879 issued Aug. 7, 1923, to W. Downing. Likewise, In U.S. Pat. No. 4,643,705 granted on Feb. 2, 1987 to H. Bober.

The present system is particularly suitable for copiers with a platen and copy sheet processing path to accommodate copying an A4 size document sheet on the platen, preferably fed long-edge-first sequentially, and to allow two of them to be copied onto a single large size copy sheet, such as A3 size, preferably fed short-edge-first. That is because a single A3 size copy sheet has the same area as two side-by-side A4 sheets, so that when the A3 sheets are center-folded they can be made into a booklet of 4 pages A4 size if it is signature printed. Also, A3 sheets can be fed short-edge-first through a copier processor designed for long-edge-first feeding of regular copy sheets. An ISO standard A3 sheet is approximately 29.7 cm. by 42 cm. or 11.69″×16.54″. An A4 sheet is approximately 21 cm. by 29.7 cm., or 8.27″×11.69″, which is close to the U. S. standard "letter size" (8.5″×11″ or 21.6×27.9 cm.). See, e.g., table of standard sheet sizes.

Various copiers can provide large copy sheet copying. The Xerox "1055" copier and the Canon NP-8570 copier, for example, provide both copying and automatic on-line folding of 28 cm. by 43 cm. (11″ by 17″) copy sheets. [This size of sheets can be signature printed and center-folded into U. S. "letter" page size booklets.]

In the description herein the term "document" or "sheet" refers to a usually flimsy sheet of paper, plastic, or other such conventional individually image substrate, and not to microfilm or electronic images which are generally much easier to manipulate. It is important to distinguish electronic copying systems, such as the "9700" noted above, which read and store images of documents electronically and create copies by writing on a photoreceptor with a laser beam, or the like, since they do not have the problems dealt with here.

The "document" here is the sheet (original or previous copy) being copied in the copier onto the outputted "copy sheet", or "copy". Related plural sheets of documents or copies are referred to as a "set". A "simplex" document or copy sheet is one having an image and page on only one side or face of the sheet, whereas a "duplex" document or copy sheet has a "page", and normally an image, on both sides. The "page numbers" are, of course, not necessary actual numbers printed on the pages. Nor are document sheet numbers referenced herein specific sheets.

The present invention is suitable for precollation copying, i.e. automatically plurally recirculated document set copying provided by a recirculating document handler or "RDH". It is also suitable for nonprecollation or postcollation copying, such as is provided by a semiautomatic document handler (SADH) or almost any automatic document feeder (ADF) or other document handler (DH), including an RDH operating in an SADH or ADF mode of operation.

Precollation, collation, recirculative, or RDH copying, as it is variably called, is a known desirable feature for a copier. It provides a number of important known advantages. In such precollation copying any desired number of collated copy sets or books may be made by making a corresponding number of recirculations of the set of documents in collated order past the copier imaging station and copying each document page (normally only once) each time it circulates over the imaging station. The copies therefrom may automatically exit the copier processor in proper oder for stacking and offsetting as precollated sets, and thus do not require subsequent collation in a sorter or collator. On-line finishing (stapling, and/or gluing, or other binding and stacking) and/or removal of completed copy sets may thus be provided while further copy sets are being made in further circulations of the same document set.

In the known conventional (nonsignature printing) copy art, as in the normal operation of the Xerox Corporation "1090" copier, it is known to provide a recirculating document handler (RDH) to recirculate document sheets to and from a stack thereof on an automatic duplex copier (and to invent duplex documents) to provide collated duplex copy sheet sets. Automatic on-line finishing thereof as by compiling, stapling, stitching and/or gluing is provided. Some examples of Xerox Corporation U.S. RDH Patents are U.S. Pat. Nos. 4,459,013 issued July 10, 1984 to T. J. Hamlin et al, 4,278,344 issued July 14, 1981 to R. B. Sahay, and 4,579,444 to T. S. Pinkney et al. Some other examples of recirculating document handlers are disclosed in U.S. Pat. Nos. 4,076,408; 4,176,945; 4,428,667; 4,330,197; 4,466,733 and 4,544,148. Another desirable platen transport for a document handler is disclosed in U.S. Pat. No. 4,618,138 issued Oct. 21, 1986 to M. Silverberg. Details of a vacuum corrugating feeder air knife and tray for an RDH are disclosed in U.S. Pat. Nos. 4,418,905 and 4,462,586. An integral semi-automatic document handler and computer form feeder (SADH/CFF), which may be an integral part of an RDH, as noted in Col. 2, paragraph 2, therein, is disclosed in U.S. Pat. No. 4,462,527.

Various of these and other patents, such as U.S. Pat. Nos. 4,579,444 and 4,176,945 above, teach plural mode, e.g. RDH/SADH, document handlers, in which documents may be loaded into either of the two inputs. Although XDJ Vol. 11, No. 1, pp. 41–42, January/February 1986 by Robert J. Michatek relates to special programming utilizing the SADH input of an RDH, in that system the set of originals are ejected to the SADH output tray and must be manually removed therefrom by the operator and placed manually in the RDH stacking tray, for each job. U.S. Pat. No. 4,391,504 issued July 5, 1983, to the same Thomas Acquaviva as here, is noted for its showing of feeding the copies (not original documents) into what appears to be an SADH input of an RDH, and is described as doing so for stacking them in the RDH tray for subsequent copies, but this is for making subsequent copies of the copy sheets rather than the original document sheets.

Xerox Disclosure Journal Publications relating to job batching and/or special programming include XDJ Vol. 7 No. 1 p. 7 January/February 1982 and XDJ Vol. 7, No. 6, p. 359 November/December 1982 by the same Thomas Acquaviva, XDJ Vol. 6 No. 4, p. 169–70 July/August 1981 by Denis J. Stemmle, and the above-noted XDJ Vol. 11, No. 1, pp. 41–42 January/February 1986 by Robert J. Michatek, using the SADH input. EK U.S. Pat. No. 4,126,390 issued Nov. 21, 1978 to John L. Connin is also on a job batching system. Various systems for automatically sequentially loading jobs into a document handler are disclosed in these references.

A disadvantage of precollation copying systems is that the documents must all repeatedly separation and circulated sequentially for coying in a predetermined order a number of times equivalent to the desired number of copy sets. Thus, increased document handling is necessitated for a precollation copying system, as compared to a post collation copying system. Therefore, maximizing document handling automation while minimizing document wear or damage is paticularly important in precollation copying.

In contrast, in a postcollation copying system, such as with an ADH or SADH, plural copies may be made at one time from each document page and collated by being placed in separate sorter bins. Thus, the document set need only be circulated (or manually or semiautomatically fed) to the imaging station once if the number of copy sets being made is less than the number of available sorter bins. A disadvantage is that the number of copy sets which can be made in one document set circulation is limited by the number of available sorter bins. Also, a sorter adds space and complexity and is not well suited for on-line finishing. However, postcollation copying, or even manual document placement, is desirable in certain copying situations to minimize document handling, particularly for delicate, valuable, thick or irregular documents, or for a very large number of copy sets. Thus, it is desirable that a document handler for a precollation copying system be compatible with, and alternatively usable for, postcollation and manual copying as well.

The present invention overcomes various of the above-discussed problems of improved copying and registration for plural image copies, including "two-up" and specifically signature printing copying and provides various of the above-noted features and advantages.

Specific features of the detailed embodiments described or shown herein include: in a copying apparatus of the type wherein an undeveloped electrostatic intermediate latent image may be formed from an original document sheet on a platen and temporarily retained on a rotatable electrostatic latent image retention member before being developed, and the developed image transferred to a copy sheet, the improvement comprising:

document handling means for sequentially individually feeding plural original document sheets in a signature page order for sequential individual copying on said copying apparatus;

means for sequentially forming and temporarily retaining closely circumferentially adjacent plural undeveloped intermediate latent images on said electrostatic image retention member from at least two said sequentially copied documents;

development means for developing said circumferentially adjacent plural latent images and transferring said plural developed circumferetially adjacent images onto one side of a copy sheet;

means for inverting and representing the copy sheet for receiving said circumferentially adjacent plural developed images on both sides thereof;

and means for repeating the above steps to form sets of signature copy sheets.

Further features provided by the exemplary systems disclosed herein, individually or in combination, include systems in which a copying method of the type wherein an undeveloped electrostatic intermediate latent image may be formed from an original document sheet at an imaging station and intermediately retained on a rotatable image retention member before being developed, and the developed image transferred to a copy sheet, the improvement comprising the steps of:

individually sequentially feeding and sequentially individually copying at least two documents in a manner to sequentially form at least two circumferentially closely adjacent undeveloped intermediate latent images on said image retention member therefrom, by retaining and returning the latent image of the first document during a rotation of said image retention member;

developing and transferring said at least two images to one side of a single copy sheet in a single continuous step;

and repeating the above steps to form sets of "two-up" copy sheets;

wherein an underdeveloped electrostatic latent image may be formed from an original document sheet imaged on a platen of said copying apparatus and retained on an intermediate latent image retention member of said copying apparatus before being developed and transferred to a copy sheet, the improvement comprising:

document handling means for individually sequentially feeding and individually copying plural original document sheets in a preselected page order on said copying apparatus platen;

means for forming and retaining at least two closely adjacent (side-by-side) plural undeveloped latent images on said image retetion member from at least two said sequentially fed documents;

means for directly sequentially developing and directly sequentially transferring said plural developed intermediate images onto one side of a single copy sheet;

wherein said intermediate latent image retention member comprises an intermediate member, separate from said means for developing and transferring, with means for transferring said plural latent images thereto;

and means for repeating the above steps to form ordered sets of copy sheets with plural adjacent images on each copy sheet;

wherein said document handling means includes means for automatically reordering a set of plural document sheets from normal order into signature pair order;

wherein the document sheets are fed transversely (widthwise) and the copy sheets are fed longitudinally (lengthwise);

wherein said sequential copying of documents is directly coordinated with said rotation of said latent image retention member to begin imaging the lead edge of the document image thereon adjacent the trailing edge of the preceding document image thereon after one or more intermediate rotations;

wherein electrostatic intermediate latent images may be formed from document sheets and temporarily retained on an electrostatic image retention member, developed, and the developed image transferred to a copy sheet, the improvement comprising:

document handling means for receiving and automatically reordering a set of document sheets from their normal order into signature page order and for sequentially individually feeding plural original document sheets in a signature page order for individual sequential copying on said copying apparatus;

means for sequentially forming two closely circumferentially adjacent plural latent images on said electrostatic image retention member from two said sequentially copied documents so reordered in said signature page order;

means for developing and transferring both said circumferentially adjacent sequential images onto one side of a copy sheet fed to said image retention member;

means for inverting and representing the copy sheet to said image retention member for receiving two more images from two more said documents on the opposite sides thereof;

and means for repeating the above steps to form sets of signature copy sheets;

wherein the document sheets are so fed transversely (widthwise) and the copy sheets are fed longitudinally (lengthwise) in said copying apparatus;

wherein said sequential imaging of document sheets is coordinated with the rotation of said image retention member to begin imaging the lead edge of a subsequent document image thereon adjacent the trailing edge of the preceding document image thereon after at least one intermediate rotation;

wherein electrostatic intermediate latent images may be formed from original document sheets and retained on an image retention member before being developed and the developed image transferred to a copy sheet, the improvement comprising the steps of:

automatically reordering a set of document sheets in normal order into signature page order by alternately feeding document sheets from opposite sides of the set of document sheets and individually sequentially feeding and individually sequentially imaging said reordered signature order document sheets to form two closely adjacent (side-by-side) latent images on said image retention member therefrom;

developing and transferring said two adjacent plural images to one side of a single copy sheet;

and repeating the above steps to form sets of signature copy sheets;

wherein the document sheets are so fed transversely (widthwise) and the copy sheets are fed longitudinally (lengthwise) in said copying apparatus;

wherein said sequential imaging of document sheets is coordinated with the rotation of said image retention member to begin imaging the lead edge of a subsequently imaged document image thereon adjacent the trailing edge of the preceding document image thereon after at least one intermediate rotation;

wherein at least one undeveloped electrostatic intermediate latent image may be formed from document sheets imaged on a platen and temporarily retained on a rotatable electostatic latent image retention member, said member having a circumferential length greater than said latent image thereon, before being developed and the developed images transferred to copy sheet, including document handling means for sequentially feeding and exchanging plural original document sheets for sequentially copying them on said platen of said copying apparatus one at a time at the same position; further including:

means for forming and temporarily retaining at least one said undeveloped latent image from one said document on said latent image retention member;

means for sequentially forming a second latent image, from a second sequentially copied document, on said same latent image retention member circumferentially closely adjacent said first latent image, said means including means for rotating said latent image retention member between said forming of said first and second latent images; and means for developing and transferring both said circumferentially adjacent first and second sequential images onto one side of a copy sheet fed to said same latent image retention member;

wherein the document sheets are so fed transversely (widthwise) and the copy sheets are fed longitudinally (lengthwise) in said copying apparatus;

wherein said sequential imaging of document sheets is coordinated with said rotation of said image retention member to begin imaging the lead edge of said first document image thereon after at least one 360 degree intermediate rotation;

wherein electrostatic intermediate latent images may be imaged from document sheets, and temporarily retained on an image retention member, developed, and the developed image transferred to a copy sheet, the improvement comprising the steps of:

individually sequentially feeding and individually sequentially copying and exchanging said document sheets;

forming circumferentially closely adjacent latent images on said image retention member from two or more of said copied documents by intermediately rotating said image retention member between said imaging of said documents and while said documents are being exchanged;

developing and transferring said adjacent images to one side of a single copy sheet fed to said image retention member;

and repeating the above steps;

wherein at least one undeveloped electrostatic intermediate latent image may be formed from document sheets imaged on a platen and temporarily retained on a rotatable electrostatic latent image retention member, said member having a circumferential length greater than said latent image thereon, before being developed and the developed images transferred to copy sheet, including sequentially feeding and exchanging plural original document sheets for sequentially copying them on said platen of said copying apparatus one at a time at the same position; further including the steps of:

forming and temporarily retaining at least one said undeveloped latent image from one said document on said latent image retention member at an exposure position;

sequentially forming a second latent image, from a second said sequentially copied document, on said same latent image retention member at said exposure position circumferentially closely adjacent said first latent image, including continuing said rotating of latent image retention member between said forming of said first and second latent images until the trail edge area of said first undeveloped latent image has just passed said exposure position again before starting said forming of said second latent image; and developing and transferring both said circumferentially adjacent first and second sequential images onto one side of a copy sheet fed to said same latent image retention member.

Some examples of various other prior art copiers with document handlers, and especially with control systems therefor, including document sheet detecting switches, etc., are disclosed in U.S. Pats. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in this art, and in general, how to program and execute document handler and copier control functions and logic with conventional or simple software instructions for conventional microprocessors. This is taught by the above and other patents and various commercial copiers. Such software may vary depending on the particular function and particular microprocessor or microcomputer system utilized, of course, but will be available to or readily programmable by those skilled in the applicable arts without experimentation from either descriptions or prior knowledge of the desired functions together with general knowledge in the general software and computer arts. It is also known that conventional or specified document handling functions and controls may be alternatively conventionally provided utilizing various other known or suitable logic or switching systems.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the examples below. The present invention will be better understood by reference to this description of these embodiments thereof, including the drawing figures (approximately to scale), wherein:

FIG. 1 is a schematic side view of an examplary image retention type copier and its document handler, fed documents by an alternating (top and bottom) feeding signature reordering feeder, incorporating the system of the invention. (In this example, the document handler is a known simplex/duplex dual mode RDH/SADH and the signature reordering feeder is one shown and described in the cross-referenced R. E. Smith application);

FIG. 2 is a schematic illustration of the exemplary mode or path of presenting documents in signature order to the platen here, i.e., fed sequentially, one-after-another, long-edge-first, to the normal (single document) common registration and imaging position on the platen;

FIG. 3 schematically illustrates the exemplary positions of the document image pairs registration on an exemplary copy sheet from the system of FIGS. 1 and 2, being fed short-edge-first through the copier as shown by the movement arrows;

Describing now in further detail the specific example illustrated in the Figures, the basic principles have been previously fully described near the beginning of this specification, and need not be repeated here. There is shown in the Figures, a copier 10 with a document handling system 20, (preferably an RDH to be described herein) both somewhat similar in part to that disclosed in the above-cited and other patents, but specifically modified and adapted for document signature feeding and copying as described herein, for sequentially transporting signature page related (signature pair order) document sheets onto and over the conventional platen imaging station 23 of the copier 10 for copying.

Figure 1:
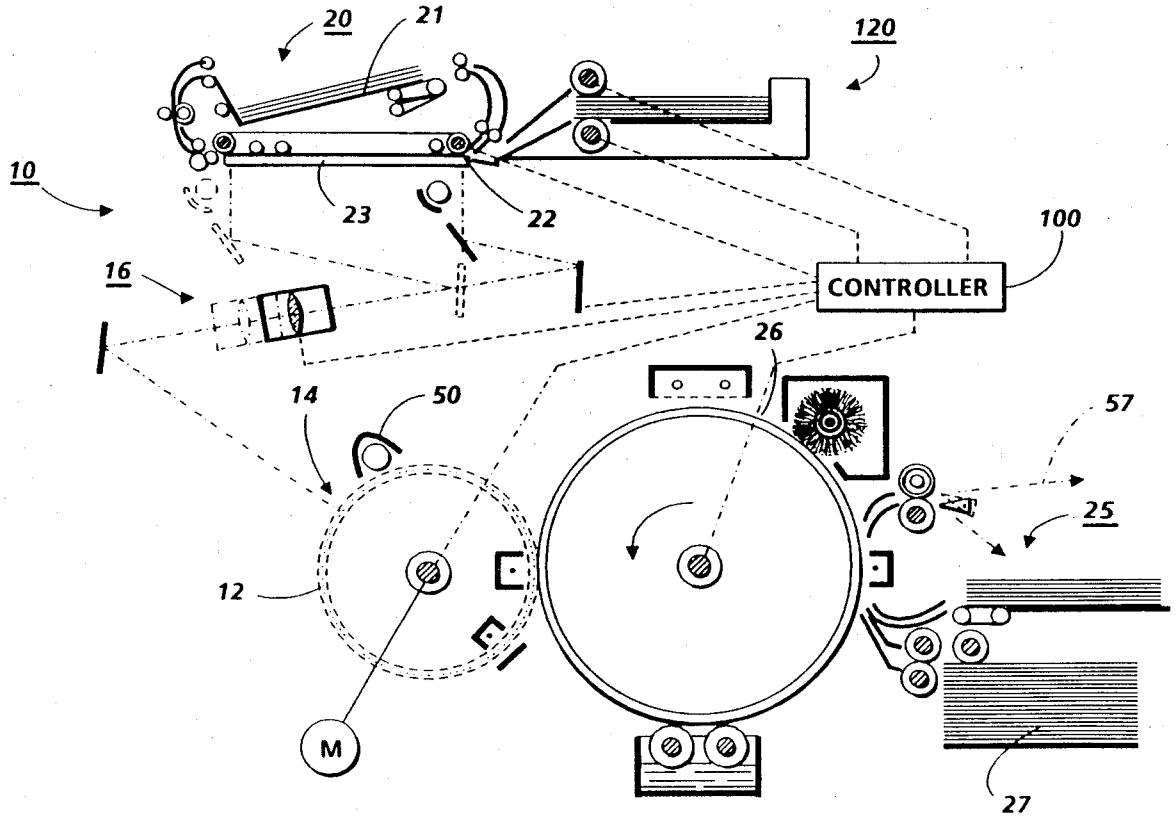

The document handling (DH) system 20 illustrated in FIG. 1 is exemplary. This document handling system 20 here is a conventional RDH. It preferably has (conventionally) two separate document inputs, a recirculating or RDH input stacking tray 21 on top, and an SADH side entrance 22 for semiautomatic document handling, or for loading documents into the RDH for subsequent recirculation. It will automatically feed and register individual document sheets from either input sequentially at the conventional registration (copying) position on the platen 23, and repeatedly recirculate them without disturbing their page order.

Other than the special system and controls and other features to be described herein, the exemplary RDH 20 may be the well known Xerox Corporation "1075" or "1090" copier RDH or other suitable xerographic copier DH's as illustrated and described in patents cited above, including U.S. Pat. No. 4,278,344, and others.

The exemplary copier 10 shown in FIG. 1, includes a xerographic latent image retention system known per se as described in the above-cited patents thereon. An image retention fine photoreceptor screen drum 12 and stations acting thereon are provided in a known manner for the first embodiment here for respectively charging, image exposing at 14, erasing, latent image transferring, etc. Documents on the platen 23 are imaged onto the photoreceptor screen 12 at imaging position 14 through a variable reduction ratio optical imaging system 16 to fit the plural document images to the selected size of copy sheet.

The copier 10 is specifically adapted here to provide duplex or simplex precollated or postcollated copy sets from either duplex or simplex original documents copied from the same RDH 20. Thus, it includes an added automatic duplex copying system 25, for inverting and returning the copy sheets for a second side image. As schematically illustrated here, this may be provided in a manner known for other types of copiers by a deflector in the normal copy sheet output path for simplex documents which deflect the copies after their first side image is transferred and fused, into a duplex buffer tray 25, which then feeds the documents back to the same transfer station for receiving a transferred image on the opposite sides of the sheets before they are again fused and ejected into the final copier output 57.

The illustrated copier 10 differs from a normal xerographic copier as described in the above-cited patents on this type or variation of xerography. In this first type, instead of the image of the documents being imaged directly onto a single photoreceptor, the latent images are initially formed on a fine wire mesh screen photoreceptor 12. Then these latent electrostatic images are transferred, as latent electrostatic images, onto a final imaging surface 26, which may be a dielectrically surface coated belt, or a drum as illustrated. These transferred latent images on the surface of the member 26 may then be conventionally developed with xerographic developer material and conventionally transferred to final copy sheets. The member 26 may be basically cleaned and erased as if it were a conventional photoreceptor surface.

In a conventional xerographic system, because the interdocument feeding delay and the scan of the optical imaging system 16 or other imaging system provides sequentially spaced, time-delayed, images, the images on the surface 26 would not normally be adjacent one another, and therefore could not be transferred as adjacent images to a single final copy sheet. However, the present system utilizes the intermediate latent image storage capability of the image retention member 12 to provide directly adjacent images on the final copy sheet, and plural such copy sheets. This is provided here by storing, directly adjacent one another, on the image retention member 12, at least two document images of sequentially exposed documents. This can be provided simply by controlling the timing of the copier 10 such that after the member 12 has imaged thereon the first document image (preferably optically reduced by the imaging system 16) the member 12 continues to rotate while the next document is being fed onto the platen 23 and then the start of the imaging of this next document is begun just as the trail edge of the latent image of the preceding document on the member 12 has reached the image exposing area 14. Thus, the image of the second document (also preferably reduced in size optically with the same proportion) begins to formulate an image on the member 12 directly adjacent, circumferentially following, the latent image of the previous document thereon, but not until after one (or more) full nonimaging intermediate rotations of the member 12.

Then, in the same, or a subsequent, rotation of the member 12, the two adjacent latent images thereon may be directly transferred as two adjacent latent images onto the surface of the final or image developing member 26, and thus may be developed thereon and transferred as directly adjacent images onto a single copy sheet fed from the illustrated copy sheet supply 27. This can be repeated for up to 100 or more copies in this first embodiment system. After the desired (preselected) number of copy sheets have been made, the member 12 is erased for receiving the next image pair.

The normal pitch distance or spacing for the latent images in conventional xerography can be completely eliminated, yet plural end-to-end images can be printed in immediately sequece at high speed onto plural individual copy sheets.

Note that the latent images on the member 12 are not developed on that member 12 in this first embodiment. Nor need that combined latent image necessarily be erased in each cycle. This enables multiple image transfers to be made of the same combined latent images without recopying the originals, providing the size (especially circumferential dimension) of the member 12 can accommodate the combined images. Thus, multiple (consecutive) signature pair or other two-up copies can be made with this system without refeeding and reimaging the originals, for reduced document handling and higher effective copying speed.

Figure 2:
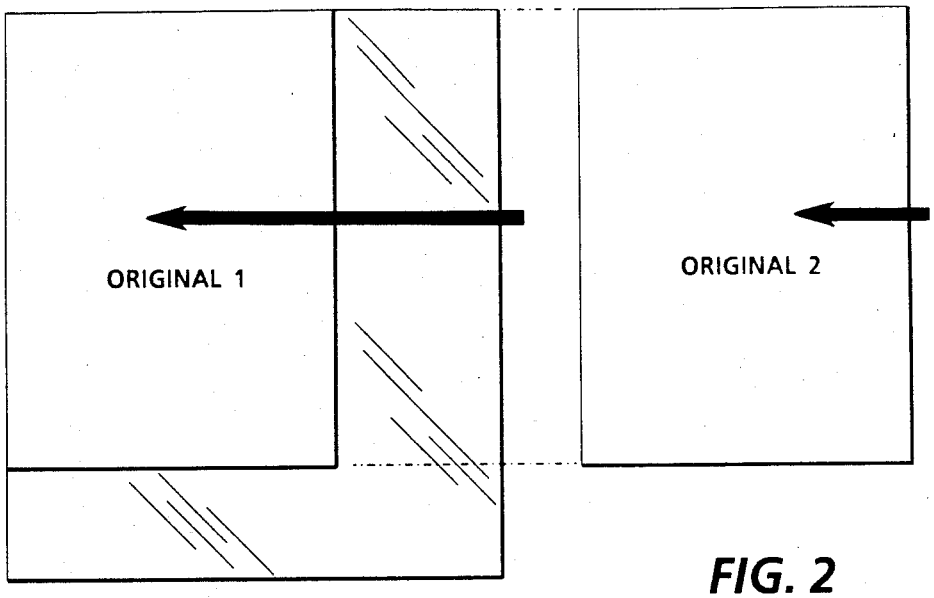

FIG. 2 illustrates the feeding of sequential documents transversely (widthwise or long-edge-first) onto the platen 23. As illustrated, the documents may be placed in the conventional single document registration position, here a conventional rear corner and downstream edge registration position. That is, with the present system, a specialized or "two-up" placement of pairs of documents on the platen simultaneously is not required.

Figure 3:
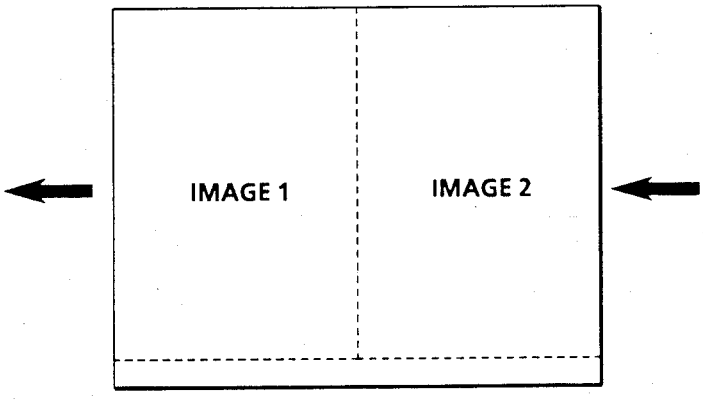

FIG. 3 provides one example of a copy sheet made with the present system from originals placed sequentially in the manner of FIG. 2. Note that here, as shown by the movement arrows, the copy sheet is being fed lengthwise or short-edge-first through the copying path of the copier, or perpendicular the document's orientation. In this regard, note the citation of U.S. Pat. No. 4,640,611, supra. This provides an additional significant advantage for signature printing, in that the second side of the copy sheet of each signature will have the correct top to bottom or head to tail image orientation without requiring alternate rotation of original pairs. Such alternately rotated orientation is illustrated in said Smith application cross-referenced herein. In contrast, with the present system all of the originals may be placed in the same, conventional orientation on the platen as illustrated in FIG. 2, without requiring any rotation of either the originals or the copy sheet. With such short-edge-fed copies and the special imaging and copying system provided herein, a conventional duplex copy path 25 may be utilized which does not require rotation of the copy sheets, merely conventional inversion.

The control of all sheet feeding is, conventionally, by the machine controller 100. The controller 100 is preferably a known programmable microprocessor, exemplified by the previously cited art. The controlled 100 conventionally controls all of the machine steps and functions described herein including the operation of the document feeder 20, the document and copy sheet gates, the feeder drives, etc. As further taught in those references, the controller 100 also conventionally provides for storage and comparison of the counts of the copy sheets, the number of documents recirculated in a document set, the desired number of copy sets and other selections by the operator through the panel of switches thereon, time delays, jam correction control, etc.

Further referring to FIG. 1, if the final images are desired to be spaced apart somewhat, by a variable margin for bookbinding or the like, a system for not copying, or erasing, the space between documents being copied on platen 23 may be provided in various known ways. A narrow band lamp or plural lamp light source 50 may be actuated by the controller 100 at the appropriate timing of the rotation of the intermediate photoreceptor 12 to expose and discharge a narrow band between images. This lamp 50 may be positioned or timed relative to the imaging areas so that the area of the intermediate member 12 (or the surface of member 26) which it discharges is between the image areas of two documents. This can also be used to prevent any possible exposure of contaminants on the platen transport adjacent the documents, or edge shadows from the documents, from being imaged onto a copy sheet. It will be appreciated that the lamp 50 may actually be a plural mode lamp which also provides normal lead edge, rear edge, and/or interdocument or pitch fadeout, which erase lamp is briefly actuated to provide this additional function as part of the present system. Various suitable prior art erase lamp systems are known in the art, and several are collected in, for example, pending U.S. application Ser. No. 908,052, filed Sept. 16, 1986 by the same Thomas Acquaviva and the same assignee.

FIG. 2 illustrates that what is being accomplished here in both embodiments is sequential, not simultaneous, document feeding and imaging, thus enabling the feeding from a conventional, single stack of documents or other input rather than requiring two separate parallel stacks of documents for feeding, with a double feeder. As noted, the present invention is desirable for, and usable with, signature printing as described in the Smith application cross-referenced at the beginning of this specification, and references cited therein, but is not limited thereto.

With the present system, two or more conventional document sheets may be desirable positioned, for example onto a single large copy sheet, yet physical document spacing or positioning is not required. All the steps may be fully automatic, and the spacing of images may be varied from directly adjacent to spaced by a binding space or margin by simply changing the timing of the document imaging relative to the known rotation position of member 12 or 26.

Desirably, this is a dual mode system which automatically provides normal document feeding and registration if this special (but simple and low cost) plural document copying mode is not selected by a switch selection by the operator on the copier control console or panel for the controller 100.

While there is described here the steps of the operation for "two-up" copying of only one pair at a time of document sheets, it will be appreciated that the present system can also be utilized for closely spacing and group copying the images of three or more documents, using the same system with only a slight operational variation. Even if the image retention member 12 were not large enough to hold all the images at once, one can be imaged at 14 at the same time a prior image is being transferred to member 26.

The number of documents to be spaced and copied as a group will, of course, vary depending on how small the documents or their optically reduced images are. It may also vary depending on whether the document sheets are being fed long-edge-first or short-edge-first (landscape or portrait). The former is preferred.

It will be appreciated that the spacing between document images on the copy, which is provided here by the distance set between the first and second latent images on the member 12 or 26, may be easily preset and changed simply by changing the timing of the start of imaging.

The copy output path 57 preferably transports the finished copy sheets directly into a connecting, on-line, modular, finishing station. There the completed, collated, copy sets may be finished by stapling, stitching, gluing, binding, and/or offset stacking. Suitable details are described in the finishing references previously cited above. Especially those cited patents disclosing center-folding and center-stapling or stitching to provide collated signature set booklets, preferably with a "roof"-type compiler for roller-folded sheets, as shown therein.

As is known from the prior art, to make signatures assembled into booklets, each signature generally comprises four pages of images of four document pages, usually copied from 4 simplex documents, but it can be from 2 duplex documents. Two documents are exposed to make side-by-side images on one side of the first copy sheet. The copy sheet or sheets are temporarily stored in a suitable duplex system buffer receptacle 25 and two other documents are exposed, and these side-by-side images placed on the opposite side of the first copy sheet to form a signature sheet which can form part of a booklet when folded in half. This signature contains four pages or images, and when folded together and nested with other appropriately paged signatures will form a complete booklet.

For clarity of the discussion herein, it will be assumed or considered that the first page or front cover of each signature set or "book" is page "1", although in commercial practice the actual printed page number "1" is normally on the third page, and first inside signature sheet, of the book and therefore on the second signature sheet. Likewise, the last copy page of the "book" or chapter is assigned here a last page number for processing purposes, even though of course, this last page is often actually blank and unnumbered, especially if there were an odd number of original pages for that book or chapter.

Figure 7:
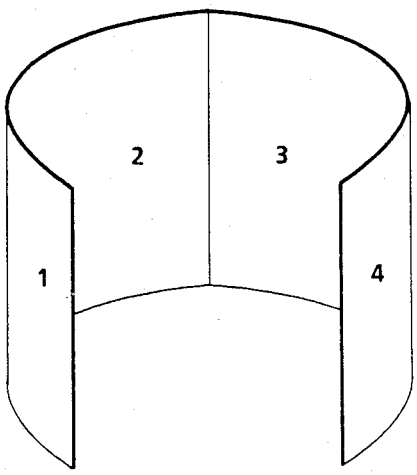
FIG. 7 is a perspective view of a copy sheet like that of FIG. 3, partially folded to show its signature printed nature, for the simple case of a 4 original page signature (a one signature sheet signature set).

For the simplest case, a single sheet (one signature) signature set, the outside pages are 1 and 4, and the inside pages are 2 and 3. Centerfolded, this makes a book of 4 pages; 1, 2, 3, 4. (See FIG. 7.)

Taking, for one example, a 20 "page" original to be signature printed onto a single quire (single signature set) booklet, this would require 5 copy sheets to make 5 signatures from these 20 pages of originals for each said booklet. The first (bottom, cover, or outside) signature sheet must be printed on its outside with page 20 on it left end (or ultimate back side) and page 1 on its right end (or ultimate front side). The obverse or inside of this same first signature sheet must be printed with page 2 on the left end and page 19 on the right end as it is facing towards the reader. This may be abbreviated as 20-1/2-19. The second signature in this example must be printed 18-3/4-17. The third signature is 16-5/6-15. The fourth is 14-7/8-13. The fifth, which here is the inside (innermost) signature, is printed 12-9/10-11.

Note that in each case each page on one end of a signature is one page number different from that page number on the same end but opposite side of the same signature, to provide consecutive page numbers when the signatures are center-folded into a booklet. However, the numbers on one end of the respective signatures are ascending (increasing) serially and those on the other end are descending (decreasing) serially.

Figure 4:
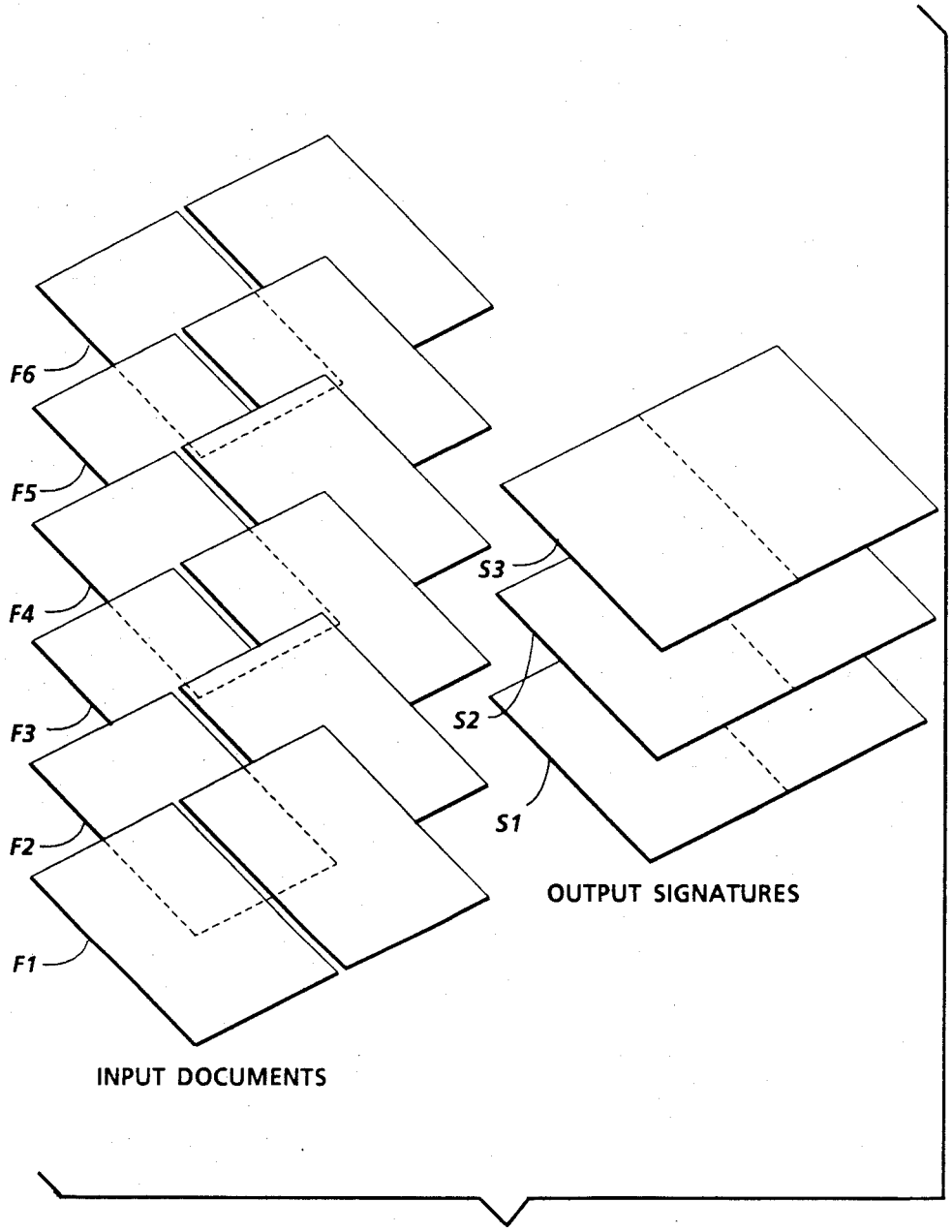
FIG. 4 illustrates known simplex document pair input on the left relative to signature copy sheet output on the right, for the production of a page-correct 3 signature booklet on a copier.

FIG. 4 illustrates document pair F1 (pages 12 and 1) being the first input document pair to be imaged on the underside of copy sheet or signature sheet S1 (as copy page numbers 1 and 12). The next document pair F2 (pages 11 and 2) is imaged on the top side of this copy sheet S1, forming the first signature. Similarly, document pairs F3 and F4 are imaged on copy sheet or signature S2 with the images of document pair F3 being on the underside. Document pairs F5 and F6 are imaged on signature S3. The final booklet of 12 pages comprises signatures S1, S2, and S3 with proper order positions of the images of document pages 1–12 for a center-folded book thereof.

Note that, as described above re the "1090" copier signature printing, the document pairs F1–F6 would, of course, be face-down on the plate, not face-up. (As they are fed onto the platen by the document feeder 20 from the RDH tray they are turned over.) [If short-edge copy feeding was not utilized, then for pair F1 the tops of the document pages face the left side of the platen; for F2, the right side, etc., i.e., with each pair alternating in directions by 180°. Also, the higher page number of each pair would be at the back of the platen.]

Figure 5:
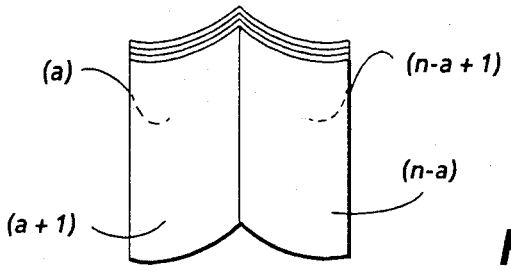
FIG. 5 is an illustration of algebraic page numbering for each individual signature as discussed herein, facing inside-open.
Figure 6:
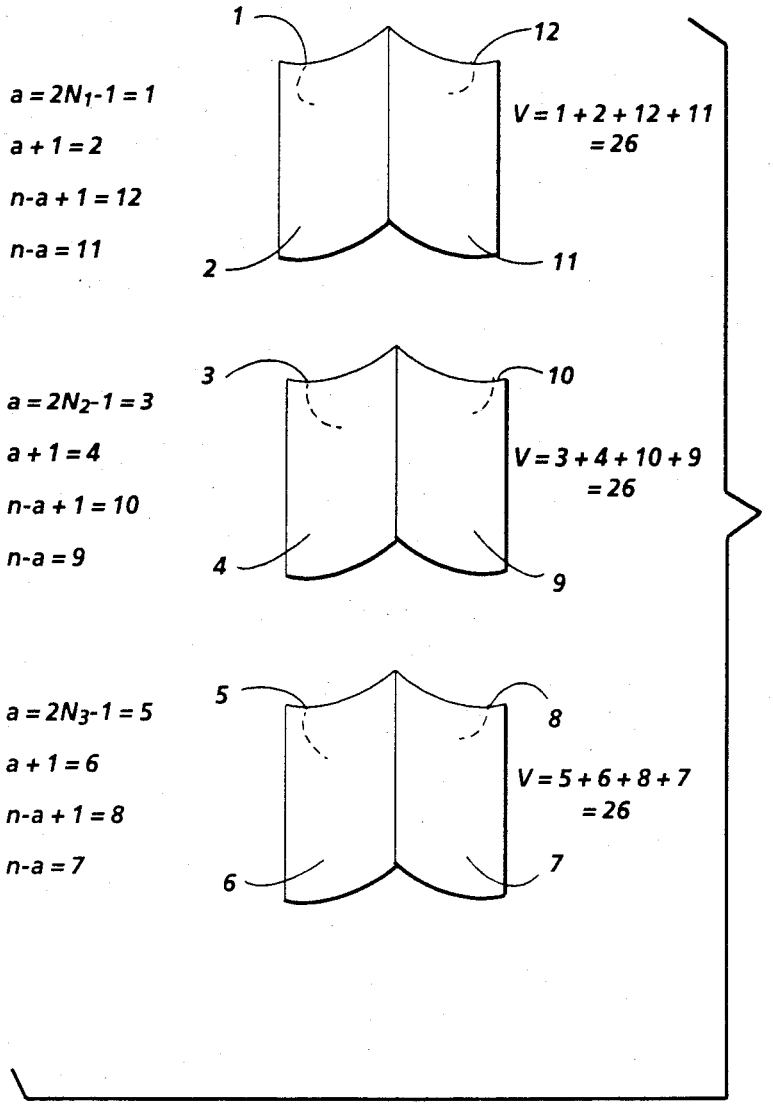
FIG. 6 is an example of folding and page numbering for a three signature booklet, facing inside-open.

In FIG. 4 the signature output is shown unfolded. In FIGS. 5 and 6 it is shown folded by the finisher, but partially opened, and in perspective, for drawing clarity. Note that in FIGS. 5 and 6 the inside of each signature is facing towards the observer and the outside is facing away, with the center fold or spline directed away from the reader. I.e., the signatures are being opened "face-up" towards the reader as they normally are when a booklet is opened, and as if the sheets were standing up.

A difficulty in producing the booklets of signatures is the page ordering and the sequence and orientation of placing the documents on the platen in order to have consecutive pages or images in the final booklet. These difficulties have been described earlier in this specification. However, the known page ordering requirements will be addessed first here.

In accordance with the system taught in the copending Bober, et al application cross-referenced at the beginning of this specification, the pagination of some typical signature (Ni) is shown in FIG. 5. Assuming:

N = Total Number of Signatures in the set or booklet, then n = 4N where n = total number of pages (including required blanks) in the booklet.

Also, $N = n_{D/4}$ (rounded up to an integer if necessary), where $n_D$ is the total number of single page documents determining the total number of signatures N required.

With these definitions, the page numbers of any given signature $N_i$, (where $N_1 = 1$; $N_2 = 2$, etc.) are given by the following equations:

For the first page number "a", $a = 2N_1 - 1$, where "a" is illustrated in FIG. 5 as the page on the left side of the outside (here the underside) of the signature $N_1$.

The right page on the underside is $(n - a + 1)$.

The left and right inside (face up here) pages are $(a + 1)$ and $(n - a)$, respectively.

It can also be seen that the total number of pages (n) or faces (after folding) is set by the number of signatures such that:

$n = n_D$ plus (0, 1, 2, 3) such that n is a multiple of four.

A useful property of signature pagination is, that for all of the signatures, there exists a unique page number total of the four pages contained on any of the signature in that set, i.e., $V - 2(n + 1)$ where V = the total value of page numbers for any signature.

This can be used to check the pagination on each signature. By comparing the check value V to the page total for each signature, the controller or operator can easily verify that the pagination is correctly done.

For example, in FIG. 6 there is shown an exploded view of a sample three signature, 12 page, booklet, and the calculation of the correct page number and the correct check value for each signature 1, 2 and 3. As illustrated in FIG. 6, there must be four correct page numbers for each signature, two of the page numbers inside or facing up and two of the page numbers outside or facing down. As shown in FIG. 5, the two outside page numbers are (a) and $(n - a + 1)$, where $(a = 2N_1 - 1)$. The two inside page numbers are $(a + 1)$ and $(n - a)$. By substituting the correct values of a and n in these forumulas for each signature, the correct value or page number is determined. That is, since here $N = 3$ (3 signatures), then $n = 4N = 12$. Also, since $a = 2N_1 - 1$, for signature 1 or $(N_1)$, then $a = 2(1) - 1 = 1$. By use of these expressions, as shown in FIG. 6, it can be seen that for the outermost signature $N_1$, the outside page numbers are 1 on the left and 12 on the right and the inside page numbers are 2 on the left and 11 on the right. For signature $N_2$, to be nested into $N_1$, the correct outside page numbers are page 3 on the left and page 10 on the right, and for the inside pages, number 4 on the left and number 9 on the right. Similarly, for signature $N_3$, the page numbers outside, or down, are 5 and 8 and the page numbers inside, or up, are 6 and 7. It can be seen, therefore, that, properly assembled, the three signatures will properly give sequential consecutive pages 1 through 12 in a signature set or booklet. For each signature, substituting the total number of pages $n = 12$ in the formula for the check value V, $V = 2(12 + 1) = 26$. It can be seen that for each signature the total value of page numbers and the check value equals 26.

Alternatively, the "7000" "slide rule", or the "1090" "look up" tables, previously described, can be preprogrammed into the copier controller, preferably into a ROM, PROM or other nonvolatile memory table to select the document pair page orders.

A further description will now be provided of the automatic document reordering and presenting system for signature order document presentation, particularly the example 120 thereof disclosed herein schematically in FIG. 1. For convenience, this will be further referred to herein as the ADRP 120. The ADRP 120 is preferably a modular unit mounted to a multiple function document handling unit 20 as illustrated in FIG. 1. The ADRP 120 module is shown in FIG. 1 mounted adjacent the RDH 20 to provide document input to its SADH input 22. The particular ADRP system will depend on whether the documents are being presented to the platen short-edge-first, or sequentially fed long-edge as here. This is compatible with a conventional RDH document handler 20. I. e., a document feeder 20 conventionally adapted to feed individual documents one at a time long-edge first from one side of the platen to approximately the same, single, registration or copying position on the platen.

The ADRP 120 feeds document sheets into the recirculating document handler 20 after they have been properly signature page ordered, so that the circulating document handler 20 can provide more efficient recirculative or precollation copying of the documents, thereby automatically providing as many precollated signature sets of the output as desired, fully automatically, without requiring any subsequent collation or reordering of the signature copy sheets. This recirculating document handler may operate in an otherwise conventional manner in accordance with the numerous above-cited patents describing RDH operations both as to the details of the RDH and also as to the manner of copying. For example, recirculative copying of simplex originals automatically to produce collated duplex copies therefrom simply by selecting the simplex/duplex copying mode switch on the controller 100.

In lieu of the separate ADRP unit 120, the RDH itself may be used to slew cycle or recirculate documents without copying, until the desired document is on the platen, then slew to the next desired document, etc., skipping the copying of intervening documents. The existing copy document counter may be used to keep track of which document in the recirculation path is to be copied. As previously noted, the RDH 20 may conventionally have an SADH entrance 22 for straight-through feeding from the side of the document handler onto the platen and off. This SADH entrance may be utilized for in-feeding a set of documents to be recirculated, fed in directly from the ADRP 120, as shown.

Although the ADRP 120 is illustrated as a separate module, this need not necessarily be the case. The ADRP 120 may be built into, as an integral part of, the RDH 20, or an SADH, or other document feeder. Alternatively, the ADRP 120 may itself provide all of the document handling, particularly if no recirculation is required. That is, the system 120 illustrated may feed the documents directly onto the plate for copying.

Referring now to the operation of the ADRP 120, it functions to take a normally collated, conventional, single set of document sheets loaded therein and to automatically reorder those document sheets from their normal sequential page order into a signature order, and to present the document sheets in proper signature page order for subsequent automatic signature copying on the copier 10 without requiring any manual reordering of either the document sheets or the signature copy sheets.

This same automatic document reordering and presenting apparatus 120 may also include automatic document rotation apparatus for simplex documents for rotating the proper, selected, simplex document sheets so that they will be the correct top to bottom page orientations for copy production on automatic duplexing copiers with long-edge-first copy sheet feeding, if the latter is desired.

The counting and selection and movement of the documents may be by conventional clutch-actuated feeding rollers or the like, all controlled at the appropriate document sheet count by the controller 100. For simplicity of illustration, the separate clutches for actuating at proper times the separate driving sections need not be identified, since this is a well known type of feeding system. As previously indicated, the particular document selected to be fed out is determined by the known copying algorithm for signature pair printing which is known and readily programmable from the information previously discussed in connection with both the prior art and the descriptions herein. Using these known desired algorithms for selecting page pairs, the ADRP 120 provides automatic presorting of the proper pages and their sequencing into the proper order for sequential presentation to the platen.

The ADRP 120 here first accepts the stack of normal serial page order document sheets in its loading tray. As the unit 120 comes to the document it wants to the feed out, in accordance with the signature algorithm instructions, it does so, and then continues to the next document sheet selected, and then ejects only that document, and so on. Thus, under the control of the copier microprocessor programming, the original document set is reordered into the proper page sequence for signature printing. This signature order separator/feeder 120 may be either 1 to N or N to 1 page order, and bottom or top feeding and top or bottom restacking, as appropriate, as are all known for RDH's. However, in the arrangement illustrated in the example here, face down document loading and feedout of the ADRP 120 is provided.

In the exemplary ADRP unit 120 here, document sheets are automatically alternately fed out from opposite sides of the original collated set or stack loaded into the unit 120. I.e., feeding a document sheet from the top, then one from the bottom, then one from the top again, etc., or the reverse sequence. This feeds out the first and last pages, then feeds out the second and the next to last pages, etc. This automatically provides proper signature order document selection and feeding. This requires two feeder/separators, as shown, one feeding from the top of the stack and one feeding from the bottom, but it is capable of higher productivity, because there are no delays for non-feed-out (slew) circulation of the set. No circulation is required in the unit 120. A prior art example of a top and bottom document stack feeder, used for a different function, is described in U.S. Pat. No. 4,184,671 issued Jan 22, 1980 to Y. Sasamori, and assigned to Rank Xerox, Ltd.

By reversing the direction and operation of the ADRP separator/feeder unit 120, or its equivalent, it may be used to automatically take back and restack, into a single stack, in the original order, the documents after they are copied. That is, to reorder the documents from signature pairs order back into normal collated order.

Note that all of the various desirable features variously described above may be accomplished by relatively simple software changes in the controller 100 and a choice in the operator display or buttons, with no or minimal hardware changes in the document handler itself.

Turning now to the second embodiment herein, this is basically identical in structure and operation to the first embodiment hereinabove except as described herein. In this embodiment, the first or screen-type image retention member 12 is simply eliminated, and therefore the imaging in this embodiment is directly onto the final imaging surface 26, which in this may be a conventional xerographic photoreceptor belt or drum. However, conventional xerography, unmodified, cannot be utilized for the present system, because in conventional xerography all of the latent images on the drum are erased in each rotation or cycle of the photoreceptor (the imaging surface 26). As noted, the present system utilizes latent image retention. This may be provided on a conventional photoreceptor by utilizing so-called "two-cycle xerography". That technology is well known and need not be described in detail herein. Note that several specific patent literature examples thereof are cited in this specification introduction.

In this system, in order to preserve the latent image of the first-presented document until that document can be ejected from the platen and the next document fed thereon and copied onto the same photoreceptor, the normal photoreceptor latent image erasing systems are disabled for at least one cycle or rotation of the photoreceptor. Likewise the image development system is disengaged or inactivated for said at least one cycle, as is the cleaning system, preferably. Thus, during one rotation or cycle of the photoreceptor drum or belt 26, after the first complete image of the first document is laid down as a complete latent image on the photoreceptor, the photoreceptor (conventionally) continues to rotate at a constant speed and that latent image is retained during that rotation. Meanwhile, the next document is being fed onto the platen for copying, and the previous document ejected, and the optics system prepared for the next scan of the next document. The start of the scan of the second document is timed to coincide with the arrival of the trail edge position of the first document latent image on the photoreceptor at the exposure position of the photoreceptor, so that the lead edge of the second document will begin to form a latent image of the second document immediately subsequent to or closely adjacent to, the trail edge of the preceding document latent image. Thus, the two latent images are directly adjacent one another circumferentially on the photoreceptor, i.e., one following the other, head to tail in the direction of movement of the photoreceptor. Note that for this system the circumferential dimension of the photoreceptor must be large enough to accommodate the maximum dimension in the scanning direction of the latent image of the first document, so that the entire latent image of the first document may be placed on the photoreceptor. However, it will be appreciated that the latent image of the first document may be an optically reduced image. Furthermore, if, as preferred, the documents are fed to the platen and scanned long-edge-first (across their smallest dimensions) then the corresponding circumferential distance required for the photoreceptor will likewise only be that of the smallest dimension of the documents to be copied. For example, even for 1:1 optical ratio (no image reduction) this would only be 21.6 centimeters (8½ inches) for a standard U. S. letter or legal-sized documents. Furthermore, it is not necessary for the circumferential distance of the photoreceptor drum or belt to be equal to two full latent image dimensions. That is because, depending on the position of the xerographic processing stations, it may be possible to begin development and then transfer of the first latent image starting with, or shortly after, the beginning of imaging of the second latent image. That is, the imaging of the second document may be conducted simultaneously with, or even started before, the formation on the same photoreceptor surface, upstream thereof, of the second latent image. Likewise, the begining of the second pair (the formation of the third latent image) may start in less than one full rotation of the photoreceptor, depending on the position of the imaging station relative to the other processing components, providing adequate spacing is provided for the complete transfer of both images to the first copy sheet and adequate document exchange time is provided for the exchange of the second document for the third document on the platen.

It will be appreciated that in such a two-cycle xerographic systems, however, that multiple copies may not normally be made from the same latent image on the photoreceptor and that the documents would be recirculated for making one exposure and one latent image per document circulation.

No special photoreceptor material is required, as conventional photoreceptors are capable of latent image retention for at least one rotation providing that latent image is not disturbed by illumination or corona charges or other disturbances.

As noted, in this system,the pairs of adjacent latent images are adjacent one another in the direction of photoreceptor surface movement (circumferentially) not transverse the photoreceptor (laterally or axially adjacent) as in noted prior art. The latter system would inherently require a wider photoreceptor to provide room for two adjacent full size document images, particularly for documents being scanned long-edge-first. Furthermore, and more importantly, lateral placement of plural images in the photoreceptor would normally require some sort of optical image shifting or document position shifting. Either of these would add additional complexity and difficulties, including the possibility of undesirable off-axis imaging optical effects. In contrast, with the present system, conventional platen sizes, conventional photoreceptor sizes, and conventional optical imaging systems may be utilized, yet "two-up" copying, including signature printing, can be provided. Furthermore, this circumferentially paired image orientation is particularly suited for copying onto short-edge-first fed copy sheets. That copy feeding orientation is known to be particualrly desirable for enabling a small copier to feed large copy sheets.

High speed turning on and turning off of development may be provided by simply camming the developer unit away from the photoreceptor during the selected rotation, as is known, or by an intermittently applied magnetic field shield as described in Xerox Disclosure Journal Vol. 12, No. 2, p. 99, published March/April 1987. Likewise for the cleaning system, if it is magnetic, as is known, or if cleaning is provided by the development unit in alternate cycles, as is also known. If conventional blade cleaning is used the cleaning blade may simply be cammed away from the photoreceptor (to avoid generating static electricity which might interfere with the latent image). Note that the various processing stations of the copier need only be disabled or inactivated briefly and intermittently, just during the time period in which the first latent image of the each pair is passing thereby.

Note that while the area of the photoreceptor bearing the first latent image is being cycled without disturbance, that it will pass the xerographic charging station (exemplarily illustrated at the 12 o'clock position in FIG. 1) and also the imaging station again. The charging station will simply be turned off at this time. Preferably the exposure position or slot, (corresponding to the optical extension of position 14 here) will be shuttered to prevent extraneous light from entering during this time period. Such an optical path shutter is illustrated, for example, in Xerox Corporation U.S. Pat. No. 3,775,008 issued Nov. 27, 1973 to R. A. Schaeffer, et al. This shutter will, of course, be open during the imaging of the respective latent images. Such a shutter may not be necessary, however, if the document exposure lamps are inactivated during flyback of the optical scanning system and the document handler is reasonably light-tight to extraneous light. Also, the optical scanning system may be "parked" with the document imaging input area positioned under a dark surface at one side of the platen when it is not scanning.

Note that for both embodiments, the surface of the member 26 is shown respectively conventionally acted on, under control of the controller 100, by illustrated embodiments of conventional xerographic stations, e.g., charging, imaging, development, transfer, and cleaning stations shown respectively at approximately the 12, 9, 6, 3 and 2 o'clock positions around the drum 26. However, these positions may be varied, or all rotated into any desired position, as is well known.

Note that with both present systems, that all the documents are all imaged overlying exactly the same area of the platen (assuming they are the same size). Also, there is a considerable time delay between copies of adjacent documents to allow for document exchange and flyback of the scanning optics system at the start of the scan position. Yet the images thereof do not overly one another. They extend circumferentially on the surface 26, preferably with two images directly together, followed by a space allowing the feeding of the next copy sheet, followed by two more images directly adjacent, then another space, etc.

Note that in both embodiments that the xerographic imaging system member 26 desirably and conventionally continues to rotate at a constant speed at all times. Yet, with these systems, a highly varied pitch is being provided. That is, two or more images are being provided with no pitch spacing therebetween for fitting both of them onto a single copy sheet, followed by normal pitch spacing between the last of those images and the first image of the next set of images to be transferred to the next copy sheet. The combined area of each image set or pair must, of course, not be greater than the area of the copy sheet on which it is to be transferred. Thus, it will be appreciated that the extra rotation or cycle of the surface 26 being used to provide the directly adjacent images for one copy sheet here is not required between copy sheets.

That is, for the adjacent images, the surface member 26 must rotate 360° between the end of the imaging of one document and the beginning of scan of the next document which is to be an adjacent image. This 360° rotation also coincides with the exchange of documents on the platen so that the next document to be imaged is in the same position on the platen yet the lead edge of that image will be placed on the surface of member 26 closely or directly adjacent the trail edge of the preceding image of the preceding document. However, once the trail edge of the second or last latent image has been formed on the surface of member 26 for that copy sheet, then this same extra rotation is not required for the next image, because the next image will be placed on a subsequent copy sheet. Therefore, the next image may be conventionally started to be formed as soon as the next document has been placed at the imaging position on the platen and scanning system is in the start-of-scan position again. (This is a conventional copier optical system in FIG. 1. The start-of-scan position of the two scanning mirrors and the illumination lamp is shown in dashed lines, and the end-of-scan position is shown in solid lines here, but if the member 12 is removed and imaging were directly onto the member 26 this would be reversed.) Thus, assuming that both the optical system flyback time and the document exchange time are less than the time for rotation of the member 26, it will be appreciated that the imaging of the first document image for the next copy sheet may be started substantially less than a full rotation of the photoreceptor after the end of the imaging of the preceding document. Accordingly, it may be seen that for literal "two-up" copying, where two document images are placed on one side of one copy sheet, that this system does not impose a substantial copier productivity loss (copy sheets per minute rate loss). The only productivity loss is the additional rotational distance of the photoreceptor to provide paired images which is in excess of the normal pitch distance of the photoreceptor, but which only occurs between first and second documents, between the third and fourth documents, the fifth and sixth documents, etc. That is, this extra partial rotation is only for every other (alternate) document imaging. It is very important to note that this 360° rotation of the photoreceptor to eliminate pitch spacing between images is occurring simultaneously with both the document exchange and the flyback of the optical scanning system from the end-of-scan to the start-of-scan position. Thus, most of this time is not being wasted. Most of it is normal, required, pitch time and movement distance of the photoreceptor during that time.

With a circumferentially longer photoreceptor, e.g., an elongate multi-sheet-pitch belt photoreceptor, there would, of course, be a greater circumferential movement required on such alternate cycles to return to the end of the previous image, and corresponding an increased time required, and therefore a somewhat greater productivity loss. Thus, for the present system, a relatively small diameter drum photoreceptor of a circumference corresponding to only two, or less than two, or even less than one, full size document latent image dimension in the scanning direction is preferred. However, such sizes of drums are now conventional on many copiers, particularly low and medium volume copiers, and therefore readily available for use with this system.

Note that both of the embodiments described hereinabove preferably utilize, in a highly desirable combination therewith, ADRP 120 system for automatically presenting the document sheets sequentially but reordered into signature page order for automatic signature copying.

While the embodiments disclosed herein are preferred, it will be appreciated from this teaching that various alternatives, modifications, variations or improvements therein may be made by those skilled in the art, which are intended to be encompassed by the following claims:

What is claimed is:

1. In a copying apparatus of the type wherein an undeveloped electrostatic intermediate latent image may be formed from an original document sheet on a platen and temporarily retained on a rotatable electrostatic latent image retention member before being developed, and the developed image transferred to a copy sheet, the improvement comprising:

document handling means for sequentially individually feeding plural original document sheets in a signature page order for sequential individual copying on said copying apparatus;

means for sequentially forming and temporarily retaining closely circumferentially adjacent plural undeveloped intermediate latent images on said electrostatic image retention member from at least two said sequentially copied documents;

development means for developing said circumferentially adjacent plural latent images and transferring said plural developed circumferentially adjacent images onto one side of a copy sheet;

means for inverting and representing the copy sheet for receiving said circumferentially adjacent plural developed images on both sides thereof;

and means for repeating the above steps to form sets of signature copy sheets.

2. The copying apparatus of claim 1 wherein said document handling means includes means for automatically reordering a set of plural document sheets from normal order into signature pair order.

3. The copying apparatus of claim 1 wherein the document sheets are fed transversely (widthwise) and the copy sheets are fed longitudinally (lengthwise).

4. The copying apparatus of claim 1, wherein said sequential copying of documents is directly coordinated with said rotation of said latent image retention member to begin imaging the lead edge of the document image thereon adjacent the trailing edge of the preceding document image thereon after one or more intermediate rotations.

5. The copying apparatus of claim 1, wherein a conventional single optical path imaging system is utilized between said platen and a single location on said image retention member.

6. In a copying apparatus wherein an undeveloped electrostatic latent image may be formed from an original document sheet imaged on a platen of said copying apparatus and retained on an intermediate latent image retention member of said copying apparatus before being developed and transferred to a copy sheet, the improvement comprising:

document handling means for individually sequentially feeding and individually copying plural original document sheets in a preselected page order on said copying apparatus platen;

means for forming and retaining at least two closely adjacent (side-by-side) plural undeveloped latent images on said image retention member from at least to said sequentially fed documents;

means for directly sequentially developing and directly sequentially transferring said plural developed intermediate images onto one side of a single copy sheet;

wherein said intermediate latent image retention member comprises an intermediate member, separate from said means for developing and trasferring, with means for transferring said plural latent images thereto;

and means for repeating the above steps to form ordered sets of copy sheets with plural adjacent images on each copy sheet.

7. The copying apparatus of claim 6, wherein a conventional single optical path imaging system is utilized between said platen and a single location on said image retention member.

8. In a copying apparatus wherein electrostatic intermediate latent images may be formed from document sheets and temporarily retained on an electrostatic image retention member, developed, and the developed image transferred to a copy sheet, the improvement comprising:

document handling means for receiving and automatically reordering a set of document sheets from their normal order into signature page order and for sequentially individually feeding plural original document sheets in a signature page order for individual sequential copying on said copying apparatus;

means for sequentially forming two closely circumferentially adjacent latent images on said electrostatic image retention member from two said sequentially copied documents so reordered in said signature page order;

means for developing and transferring both said circumferentially adjacent sequential images onto one side of a copy sheet fed to said image retention member;

means for inverting and representing the copy sheet to said image retention member for receiving two or more images from two more said documents on the opposite sides thereof;

and means for repeating the above steps to form sets of signature copy sheets.

9. The copy apparatus of claim 8 wherein the document sheets are so fed transversely (widthwise) and the copy sheets are fed longitudinally (lengthwise) in said copying apparatus.

10. The copying apparatus of claim 8 wherein said sequential imaging of document sheets is coordinated with the rotation of said image retention member to begin imaging the lead edge of a subsequent document image thereon adjacent the trailing edge of the preceding document image thereon after at least one intermediate rotation.

11. The copying apparatus of claim 8, wherein a conventional single optical path imaging system is utilized to form the images on said image retention member.

12. In a copying apparatus wherein at least one undeveloped electrostatic intermediate latent image may be formed from document sheets imaged on a platen and temporarily retained on a rotatable electrostatic latent image retention member, said member having a circumferential length greater than said latent image thereon, before being developed and the developed images transferred to copy sheet, including document handling means for sequentially feeding and exchanging plural original document sheets for sequentially copying them on said platen of said copying apparatus one at a time at the same position; further including:

means for forming and temporarily retaining at least one said undeveloped latent image from one said document on said latent image retention member;

means for sequentially forming a second latent image, from a second sequentially copied document, on said same latent image retention member circumferentially closely adjacent said first latent image, said means including means for rotating latent image retention member between said forming of said first and second latent images; and means for developing and transferring both said circumferentially adjacent first and second sequential images onto one side of a copy sheet fed to said same latent image retention member.

13. The copying apparatus of claim 12 wherein the document sheets are so fed transversely (widthwise) and the copy sheets are fed longitudinally (lengthwise) in said copying apparatus.

14. The copying apparatus of claim 12 wherein said sequential imaging of document sheets is coordinated with said rotation of said image retention member to begin imaging the lead edge of said second document image thereon adjacent the trailing edge of said first document image thereon after at least one 360 degree intermediate rotation.

15. The copying apparatus of claim 12, wherein a conventional single optical path imaging system is utilized between said platen and a single location on said image retention member.

16. In a copying method of the type wherein an undeveloped electrostatic intermediate latent image may be formed from an original document sheet at an imaging station and intermediately retained on a rotatable image retention member before being developed, and the developed image transferred to a copy sheet, the improvement comprising the steps of:

individually sequentially feeding and sequentially individually copying at least two documents in a manner to sequentially form at least two circumferentially closely adjacent undeveloped intermediate latent images on said image retention member therefrom, by retaining and returning the latent image of the first document during a rotation of said image retention member;

developing and transferring said at least two images to one side of a single copy sheet in a single continuous step;

and repeating the above steps to form sets ot "two-up" copy sheets.

17. The copying method of claim 16, wherein a conventional single optical path imaging system is utilized between said imaging station and a single location on said image retention member.

18. In a copying method wherein electrostatic intermediate latent images may be formed from original document sheets and retained on an image retention member before being developed and the developed image transferred to a copy sheet, the improvement comprising the steps of:

automatically reordering a set of document sheets in normal order into signature page order by alternately feeding document sheets from opposite sides of the set of document sheets and individually sequentially feeding and individually sequentially imaging said reordered signature order document sheets to form two closely adjacent (side-by-side) latent images on said image retention member therefrom;

developing and transferring said two adjacent plural images to one side of a single copy sheet;

and repeating the above steps to form sets of signature copy sheets.

19. The copying method of claim 18 wherein the document sheets are so fed transversely (widthwise) and the copy sheets are fed longitudinally (lengthwise) in said copying apparatus.

20. The copying method of claim 18 wherein said sequential imaging of document sheets is coordinated with the rotation of said image retention member to begin imaging the lead edge of a subsequently imaged document image thereon adjacent the trailing edge of the preceding document image thereon after at least one intermediate rotation.

21. The copying method of claim 18, wherein a conventional single optical path imaging system is utilized to form the images on said image retention member.

22. In a copying method wherein electrostatic intermediate latent images may be imaged from document sheets, and temporarily retained on an image retention member, developed, and the developed image transferred to a copy sheet, the improvement comprising the steps of:

individually sequentially feeding and individually sequentially copying and exchanging said document sheets;

forming circumferentially closely adjacent latent images on said image retention member from two or more of said copied documents by intermediately rotating said image retention member between said imaging of said documents and while said documents are being exchanged;

developing and transferring said adjacent images to one side of a single copy sheet fed to said image retention member;

and repeating the above steps.

23. The copying method of claim 22, wherein a conventional single optical path imaging system is utilized to form the images on said image retention member.

24. In a copying method wherein at least one undeveloped electrostatic intermediate latent image may be formed from document sheets imaged on a platen and temporarily retained on a rotatable electrostatic latent image retention member, said member having a circumferential length greater than said latent image thereon, before being developed and the developed images transferred to copy sheet, including sequentially feeding and exchanging plural original document sheets for sequentially copying them on said platen of said copying apparatus one at a time at the same position; further including the steps of:

forming and temporarily retaining at least one said undeveloped latent image from one said document on said latent image retention member at an exposure position;

sequentially forming a second latent image, from a second said sequentially copied document, on said same latent image retention member at said exposure position circumferentially closely adjacent said first latent image, including continuing said rotating of latent image retention member between said forming of said first and second latent images until the trail edge area of said first undeveloped latent image has just passed said exposure position again before starting said forming of said second latent image; and developing and transferring both said circumferentially adjacent first and second sequential images onto one side of a copy sheet fed to said same latent image retention member.

25. The copying method of claim 24, wherein a conventional single optical path imaging system is utilized to form the images on said image retention member.

* * * * *